US011225359B2

(12) United States Patent
Makofsky et al.

(10) Patent No.: US 11,225,359 B2
(45) Date of Patent: Jan. 18, 2022

(54) INSERT FOR A FLAT-SIZED FLEXIBLE ENVELOPE

(71) Applicant: Conformer Products, Inc., Port Washington, NY (US)

(72) Inventors: Robert Makofsky, New York City, NY (US); Murray Rundle, Stouffville (CA)

(73) Assignee: CONFORMER PRODUCTS INC., Port Washington, NY (US)

( * ) Notice: Subject to any disclaimer, the term of this patent is extended or adjusted under 35 U.S.C. 154(b) by 0 days.

(21) Appl. No.: 16/717,462

(22) Filed: Dec. 17, 2019

(65) Prior Publication Data

US 2020/0189798 A1 Jun. 18, 2020

Related U.S. Application Data

(60) Provisional application No. 62/868,326, filed on Jun. 28, 2019, provisional application No. 62/781,399, filed on Dec. 18, 2018.

(51) Int. Cl.
*B65D 27/02* (2006.01)
*B65D 27/08* (2006.01)

(52) U.S. Cl.
CPC ..... *B65D 27/02* (2013.01); *B65D 27/08* (2013.01)

(58) Field of Classification Search
CPC ..... B65D 27/02; B65D 27/08; B65D 5/443; B65D 5/4204; B65D 5/029; B65D 5/5007; A45D 27/22
USPC ... 229/75, 76, 100, 121, 122.2, 124, 125.15, 229/229, 939
See application file for complete search history.

(56) References Cited

U.S. PATENT DOCUMENTS

2002/0069619 A1* 6/2002 Abasolo ..... C12M 45/22 53/449
2005/0274048 A1* 12/2005 Gerrie ..... A47G 1/141 40/124.06
2011/0100845 A1* 5/2011 Meech ..... B65D 75/366 206/232
2018/0162597 A1* 6/2018 Jobe ..... B65D 65/40

* cited by examiner

*Primary Examiner* — Justin V Lewis
(74) *Attorney, Agent, or Firm* — Francis C. Hand; Carella, Byrne et al

(57) ABSTRACT

The blank is made of corrugated board that is foldable in half with at least one half having a cutout to receive a good to be shipped. The folded blank forms a flexible insert that may be inserted into a pocket of a mailer. In one embodiment, one half of the blank is formed with multiple cutouts to receive a plurality of goods of the same or different sizes. In another embodiment, both halves of the blank are formed with cutouts.

18 Claims, 7 Drawing Sheets

INSERT FOR A FLAT-SIZED FLEXIBLE ENVELOPE

This is a Non-Provisional Patent Application and claims the benefit of Provisional Patent Application 62/781,399, filed Dec. 18, 2018 and Provisional Patent Application No. 62/868,326, filed Jun. 28, 2019.

This invention relates to an insert for a flat-sized flexible envelope. More particularly, this invention relates to an insert for a flat-sized flexible envelope that conforms to USPS requirements for flexibility and uniform thickness of flat-size pieces.

As is known, various types of envelopes have been constructed for use in mailing items, such as digital video disks (DVDs) and compact disks (CDs). In some cases, the envelopes have been provided with padding, such as described in U.S. Pat. No. 5,662,420, wherein a macerated paper layer is sandwiched between two layers of paper.

In still other cases, as described in U.S. Pat. Nos. 5,544,473 and 7,108,650, it has been known to provide envelopes in which a packing material is inserted to receive an item for shipping. Also, US 2008/0290145 describes various inserts of foam, plastic or corrugated to be used with flexible envelopes.

Still other constructions have been known for use in shipping medical tests specimens wherein a receptacle is provided to receive a test specimen and the receptacle placed in an envelope, such as described in U.S. Pat. No. 5,620,097.

United States Postal Service (USPS) regulations (see 39 CFR Part 111) provide standards for domestic mailing services that set forth minimum flexibility and uniform thickness criteria for flat-sized pieces.

The USPS has established certain requirements that determine if a package is suitable for USPS Flat sorting rates.

Thickness—Flats must be under ¾" thick.

Uniform Thickness—Flat-size mail pieces must be uniformly thick so that any bumps, protrusions, or other irregularities do not cause more than ¼-inch variance in thickness.

Flexibility—Flat-size pieces must be flexible. Mail pieces under 10" long must be able to flex 1" along the long edge and short edge of the package of the package. For mail pieces over 10" long, the mail piece must be able to flex 2" along the long edge and short edge of the package.

Mailers must secure Goods to prevent shifting of more than 2 inches.

Flats must be more than 11½ inches long, or more than 6⅛ inches high, or more than ¼ inch thick Flats may not exceed 15 inches long, or more than 12 inches high, or more than ¾ inch thick.

Accordingly, it is an object of the invention to provide an insert for shipping goods in a package that satisfies the criteria for flat-sized pieces of the USPS.

It is another object of the invention to provide an envelope construction with a flexible insert for shipping items of rigid or non-rigid nature.

It is another object of the invention to be able to mail an item in a manner that qualifies as a flat-sized piece postage in the United States.

Briefly, the invention provides a flexible insert in the form of a tray that occupies the inside of a package in a manner that allows the package to flex with an item to be shipped or mailed within the insert. The item to be received within the insert may be of rigid nature or non-rigid nature.

The flexible insert is formed of a blank of corrugated board that is foldable in half with at least one half having a cutout to receive a good to be shipped.

In one embodiment, each half of the blank of corrugated board is formed with a cutout. Prior to folding of the board, one or more goods are placed on one half of the board partially within the cutout and in contact with the board either unsecured or secured with tape, adhesive, or other binding method to prevent the goods from shifting.

In another embodiment, one half of the board is formed with a plurality of cutouts and the other half remains smooth. Prior to folding of the board, goods are placed in the cutouts and secured with tape, adhesive, or other binding method to prevent the goods from shifting. Thereafter, the smooth half of the board is folded over the taped side of the goods so that the goods project or not through the cutouts. The resultant insert may then be inserted into a pocket of a mailer.

In still another embodiment, both halves of the board are formed with a plurality of cutouts. Prior to folding, goods of different sizes may be placed in the cutouts of one half and secured in place as with tape. Thereafter, the other half of the board is folded over the taped side of the goods so that the goods project or not through the cutouts. The resultant insert may then be inserted into a pocket of a mailer.

These and other objects and advantages of the invention will become more apparent from the following detailed description taken in conjunction with the accompanying drawings wherein.

Figure 1:
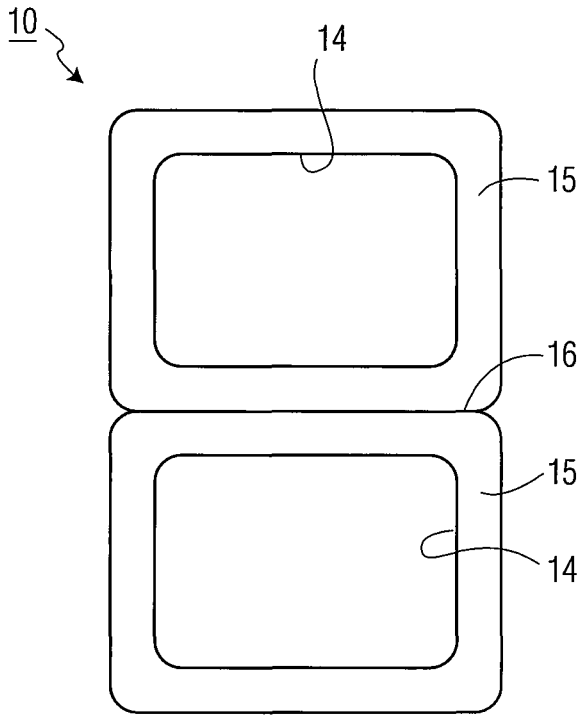
FIG. 1 illustrates a view of a blank for making an insert with a pair of sections that are integrally hinged together for folding over onto each other in accordance with the invention.

Referring to FIG. 1, the blank 10 is constructed to form an insert 11 (see FIG. 2) that fills the perimeter of a paper mailer 13, keeping small goods in the middle of the package, and creating a uniform thickness throughout.

As illustrated, the blank 10 is made of one piece of corrugated board with a singular cutout (opening) 14 through the middle section of each half of the blank 10 resulting in a perimeter or frame 15 in each half of the blank 10. A score line 16 may also be provided to separate the two halves of the blank 10 and to facilitate folding.

The blank 10 is dimensioned to be 8¾ inch by 13½ inch so that when folded in half, the resultant insert 11 has a width of 8¾ inches and a length of 6¾ inches. A spine may also be added to a thicker sheet of corrugate to make folding over easier.

Prior to folding of the blank 10, one or more goods 17 (see FIG. 2) are placed on one half of the blank 10 within the cutout 14 and in contact with the frame 15 either unsecured or secured with tape, adhesive, or other binding method to prevent the goods from shifting. Next, the blank 10 is folded upon itself in a booklet fashion creating a folded blank with overlapping cutouts 14. The two halves of the blank 10 are not secured to each other but may be so secured. Also, a strip of peel and seal tape (not shown) may be applied to the inside of one of the frames 15 so that goods can be applied to the tape to prevent shifting.

Figure 2:
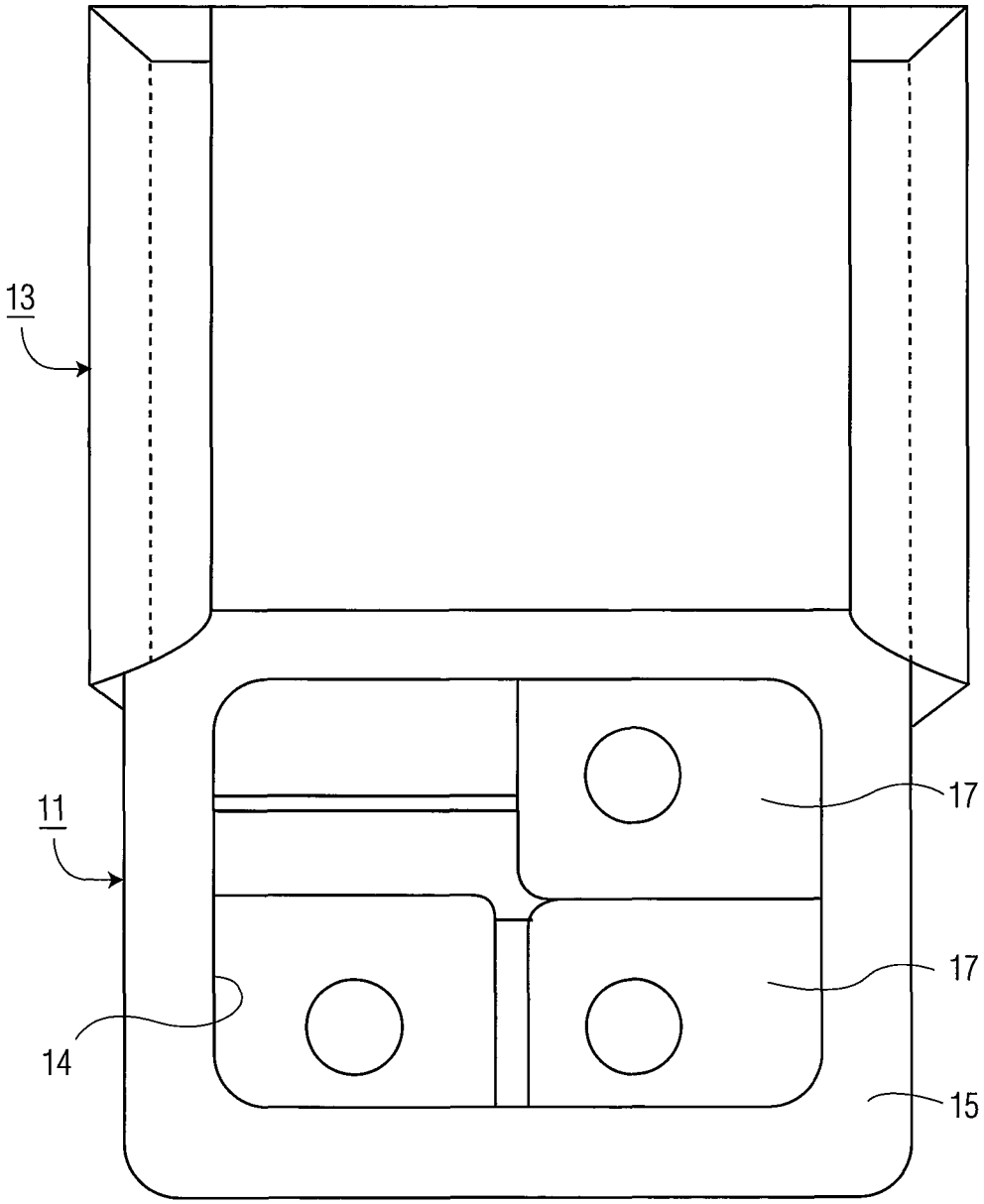
FIG. 2 illustrates a view of the insert of FIG. 1 during insertion in an envelope.

Referring to FIG. 2, after folding over of the blank 10 on the goods 17, the resultant insert 11 is inserted into a pocket of the mailer 13, for example, a paper mailer of standard or an expandable construction, as described in U.S. Pat. Nos. 6,227,444 and 9,352,879.

Figure 3:
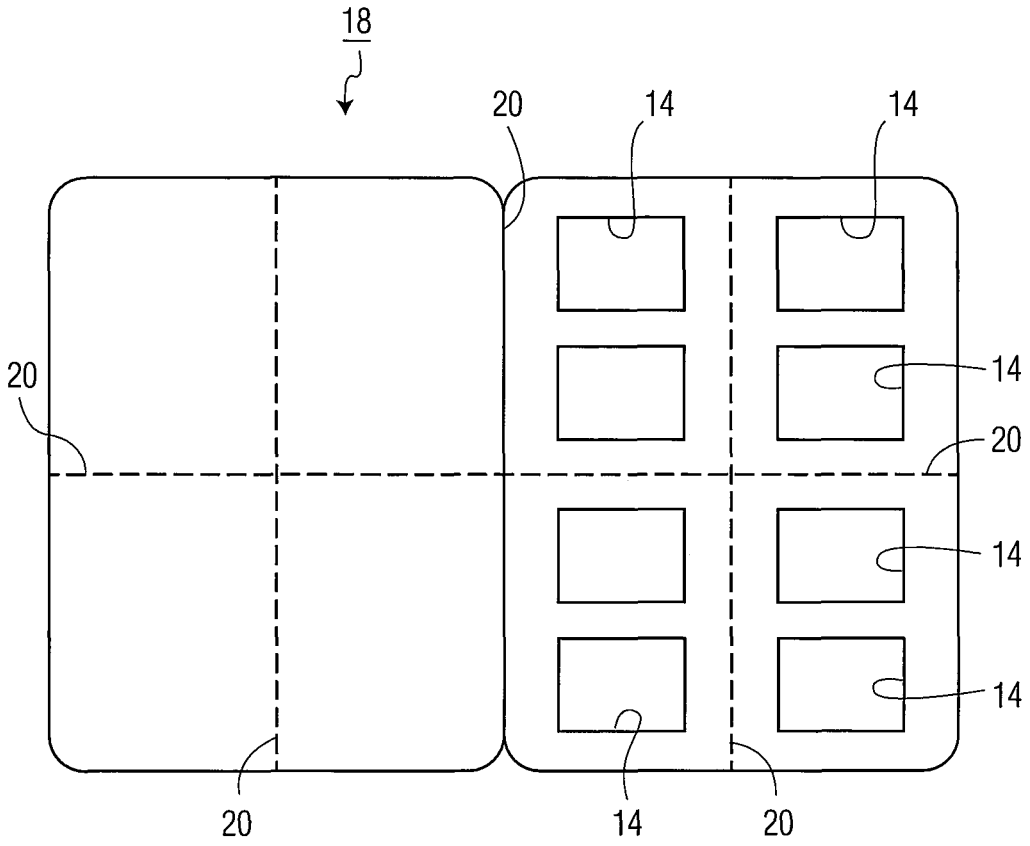
FIG. 3 illustrates a view of a modified blank for making a fold-over insert with multiple openings in one half in accordance with the invention.

Referring to FIG. 3, the blank 18 for making a fold-over insert 19 (see FIG. 5) is made of one piece of corrugated board with a plurality of cutouts 14, for example eight cutouts, through one half of the blank 18 while the other half of the blank 18 remains without cutouts, i.e. smooth.

Score lines 20 may also be provided in each half of the blank 18 and between the halves to facilitate folding.

Figure 4:
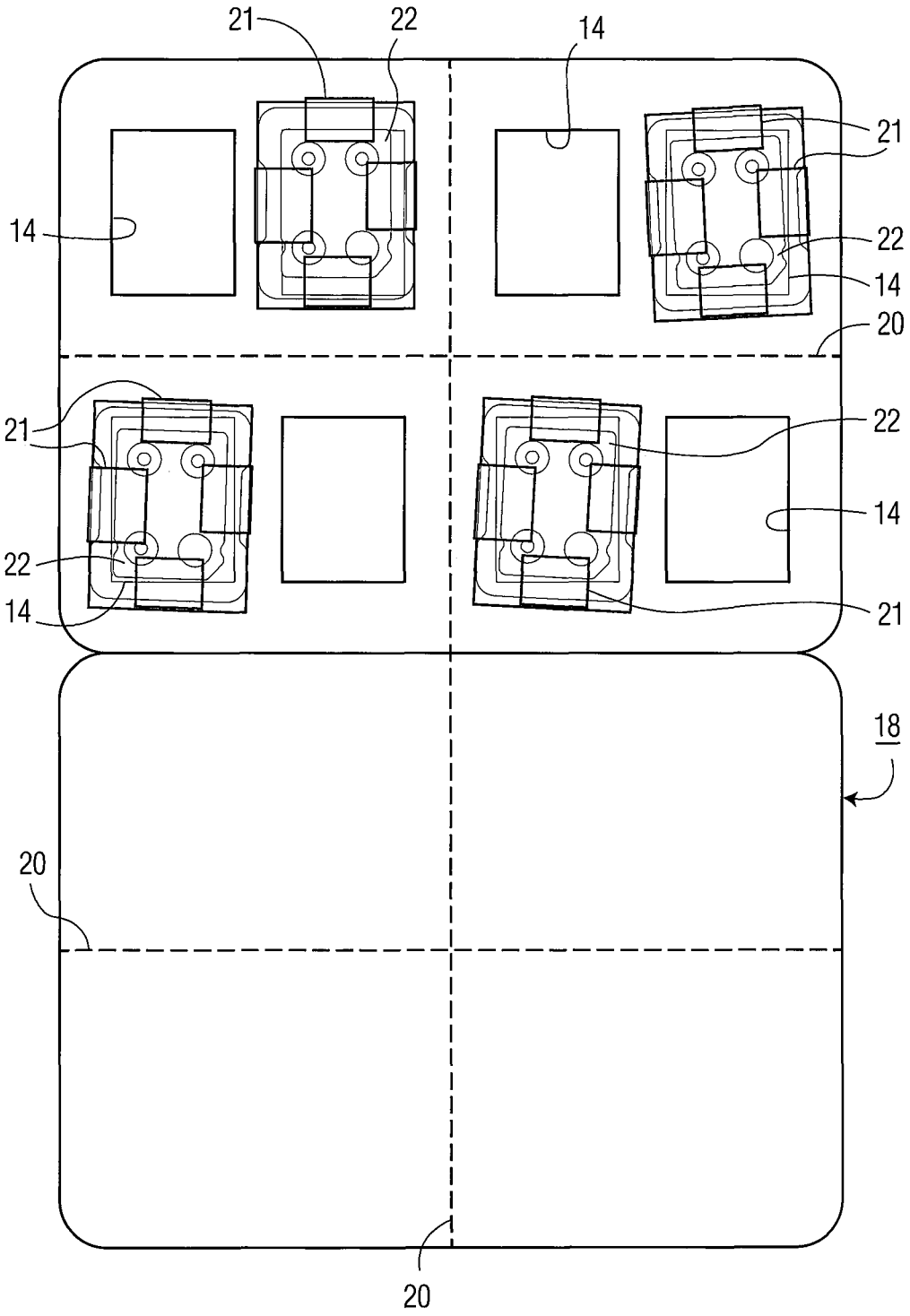
FIG. 4 illustrates a view of the blank of FIG. 3 with goods secured with some of the openings prior to folding over of the blank.

Referring to FIG. 4, in use, the cutouts 14 of the blank 10 provide spaces to receive goods 22. In addition, each of the goods 22 may be secured or not within a cutout 14 by tape 21.

Figure 5:
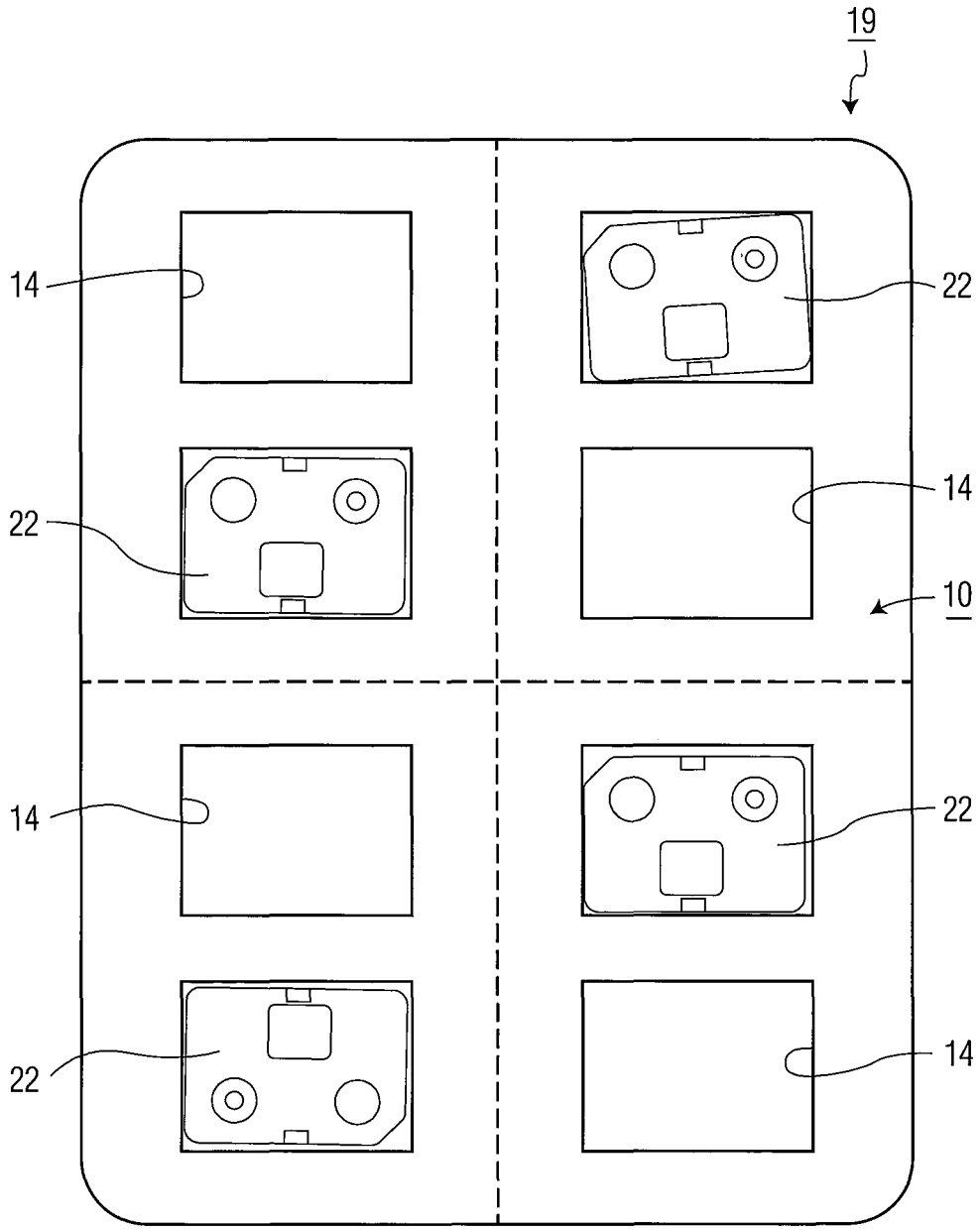
FIG. 5 illustrates a view of an insert formed by folding over of the blank of FIG. 4.

Referring to FIG. 5, after positioning of the goods 22 in place in the cutouts 14, the smooth half of the blank 18 is folded over the goods 22 so that the goods 22 project through the cutouts 14. In the event that the goods 22 are of a thickness equal to the thickness of the blank 18, the goods would not project through the cutouts 14. The resultant folded over blank 18 and contained goods 22 form an insert 19 that can be inserted into a pocket of a mailer 13, as above, for example, a paper mailer of standard or an expandable construction, as described in U.S. Pat. Nos. 6,227,444 and 9,352,879.

Figure 6:
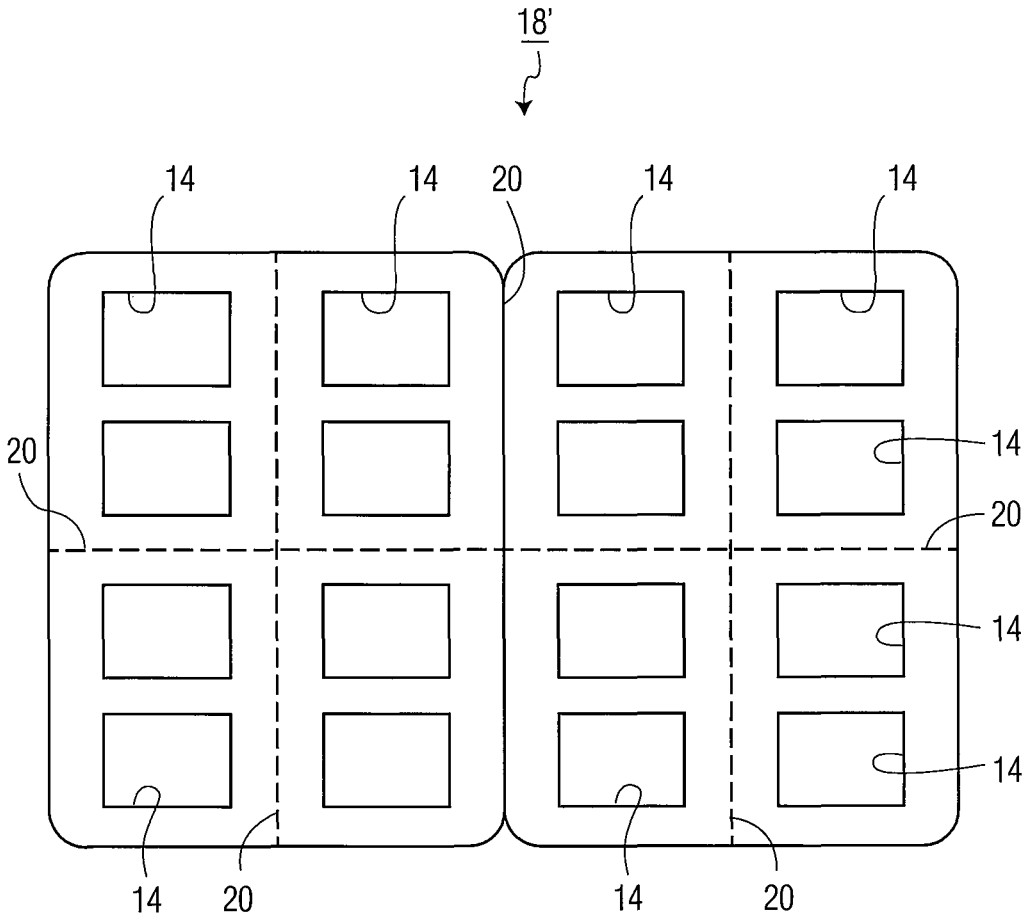
FIG. 6 illustrates a view of a modified blank for making a fold-over insert with multiple openings in both halves in accordance with the invention.

Referring to FIG. 6, wherein like reference characters indicate like arts as above, the blank 18' for making a fold-over insert 19' (see FIG. 7) is made of one piece of corrugated board with a plurality of cutouts 14, for example eight cutouts, in each half of the blank 18'. Score lines 20 may also be provided in each half of the blank 18' to facilitate folding.

In use, the cutouts 14 of the blank 10 provide spaces to receive goods 21, 22 of different thicknesses. In addition, each of the goods 21, 22 may be secured within a respective cutout 14 by tape in a manner as above. (see FIG. 4).

Figure 7:
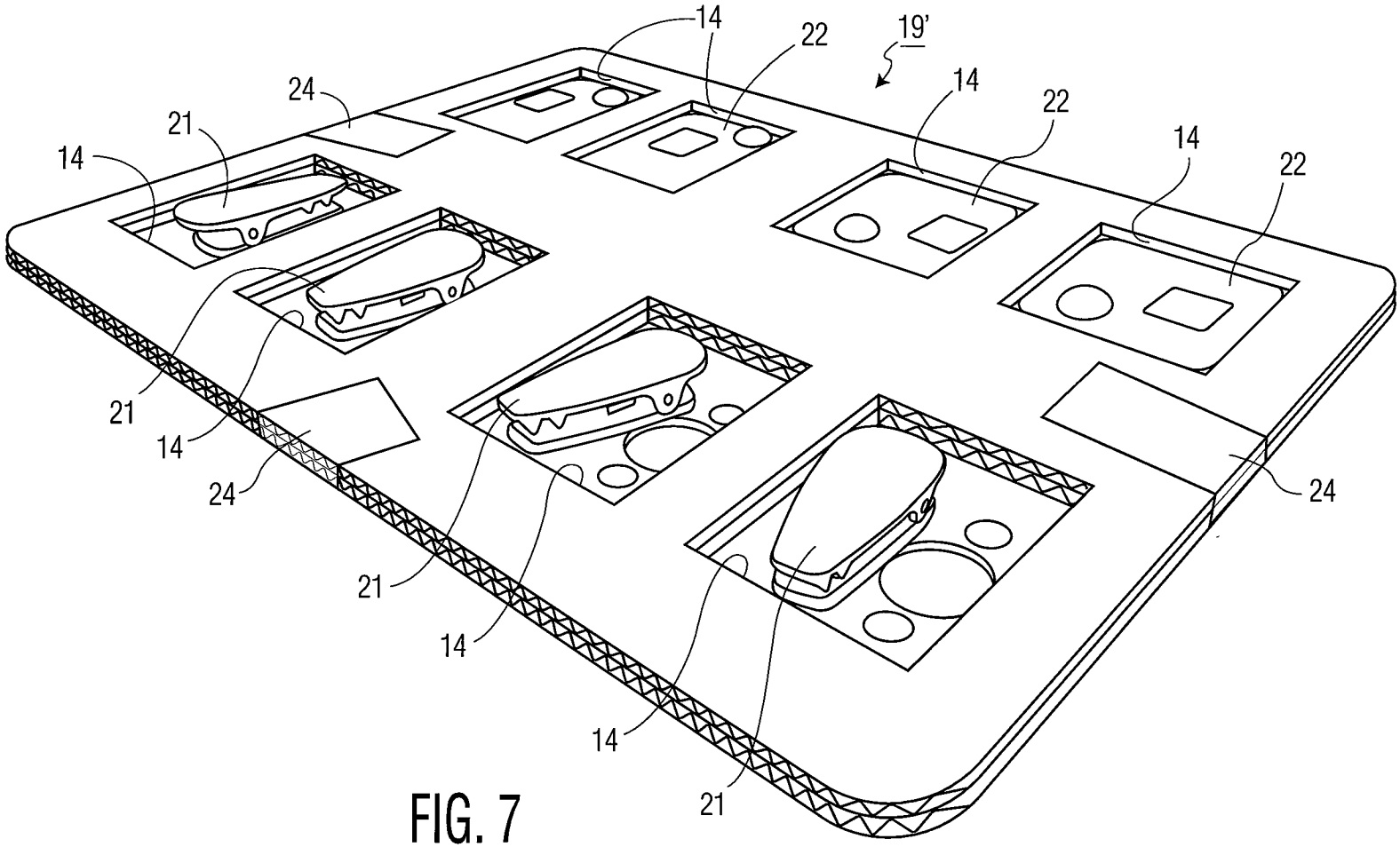
FIG. 7 illustrates a view of an insert made with the blank of FIG. 6 with different sized goods in the openings.

Referring to FIG. 7, after positioning of the goods 21, 22 in place in the cutouts 14 of one half of the blank 18', the other half of the blank 18' is folded over the taped side of the goods 21, 22 so that the goods 21, 22 project through the cutouts 14. In the event that the goods are of a thickness equal to the thickness of the blank 18', the goods would not project through the cutouts 14. The resultant folded over blank 19' and contained goods 21, 22 form an insert that can be inserted into a pocket of a mailer 13, as above, for example, a paper mailer of standard or an expandable construction, as described in U.S. Pat. Nos. 6,227,444 and 9,352,879.

Thus, the invention provides an insert for shipping goods in a package that satisfies the criteria for flat-sized pieces of the USPS. The invention also provides an envelope construction with a flexible insert for shipping items of rigid or non-rigid nature.

The invention also enables a shipper, for example of commercial goods, to mail an item in a manner that qualifies as a flat-sized piece postage in the United States.

What is claimed is:

1. An insert for an envelope, said insert consisting of a blank of corrugated board having a first half and a second half for folding over said first half; at least one of said halves having a cutout to receive a good to be shipped.

2. An insert as set forth in claim 1 wherein each of said first half and said second half has a width of 8¾ inches and a length of 6¾ inches.

3. An insert as set forth in claim 1 wherein each of said first half and said second half has a cutout in overlapping relation with each other.

4. An insert as set forth in claim 1 wherein said first half has a plurality of cutouts and said second half is smooth.

5. An insert as set forth in claim 1 wherein said first half has a plurality of cutouts and said second half has a plurality of cutouts.

6. An insert for a mailer, said insert consisting of a blank of corrugated board having two halves disposed in folded over relation with a cutout in at least one half thereof; and at least one good disposed between said halves and at least partially within said cutout.

7. An insert as set forth in claim 6 wherein each of said halves has a width of 8¾ inches and a length of 6¾ inches.

8. An insert as set forth in claim 6 wherein one of said halves has a plurality of cutouts with each said cutout having a good therein and the other of said halves is smooth.

9. An insert as set forth in claim 6 wherein each of said halves has a plurality of cutouts.

10. An insert for an envelope having a pocket, said insert consisting of a blank of corrugated board having a first half and a second half for folding over said first half for insertion into the pocket of the envelope; at least one of said halves having a cutout to receive a good to be shipped and a thickness of the envelope with said blank in said pocket being less than ¾ inch to form a flexible package.

11. An insert as set forth in claim 10 wherein each of said first half and said second half has a width of 8¾ inches and a length of 6¾ inches.

12. An insert as set forth in claim 10 wherein each of said first half and said second half has a cutout in overlapping relation with each other.

13. An insert as set forth in claim 10 wherein said first half has a plurality of cutouts and said second half is smooth.

14. An insert as set forth in claim 10 wherein said first half has a plurality of cutouts and said second half has a plurality of cutouts.

15. In combination, a mailer having a pocket; and an insert inserted into said pocket, said insert consisting of a blank of corrugated board having a first half and a second half folded over said first half; at least one of said halves having a cutout receiving a good to be shipped in said mailer and a thickness of said mailer with said insert in said pocket being less than ¾ inch to form a flexible package.

16. The combination as set forth in claim 15 wherein each of said first half and said second half has a cutout in overlapping relation with each other.

17. The combination as set forth in claim 15 wherein said first half of said insert has a plurality of cutouts receiving goods to be shipped in said mailer and said second half of said insert is smooth.

18. The combination as set forth in claim 15 wherein said first half of said insert has a plurality of cutouts receiving goods to be shipped in said mailer and said second half of said insert has a plurality of cutouts receiving the goods.

* * * * *